US005178559A

United States Patent [19]

Mello

[11] Patent Number: 5,178,559

[45] Date of Patent: Jan. 12, 1993

[54] STRESS RELIEF BACKSHELL ASSEMBLY

[75] Inventor: Craig S. Mello, Tiverton, R.I.

[73] Assignee: The United States of America as represented by the Secretary of the Navy, Washington, D.C.

[21] Appl. No.: 904,625

[22] Filed: Jun. 26, 1992

[51] Int. Cl.[5] ..... H01R 13/595

[52] U.S. Cl. ..... 439/472

[58] Field of Search ..... 439/470, 472, 473

[56] References Cited

U.S. PATENT DOCUMENTS

| | | | |
|---|---|---|---|
| 3,781,765 | 12/1973 | Schleicher | 439/472 |
| 3,880,490 | 4/1975 | Belmont | 439/472 |
| 3,930,710 | 1/1976 | Sollanek | 439/472 |
| 4,021,092 | 5/1977 | Ericson, Jr. | 439/472 |
| 4,213,664 | 7/1980 | McClenan | 439/472 |
| 4,280,746 | 7/1981 | Ignatowicz | 439/470 |
| 4,808,123 | 2/1989 | Dee et al. | 439/470 |
| 4,840,581 | 6/1989 | Leufert et al. | 439/473 |

*Primary Examiner*—Gary F. Paumen

*Attorney, Agent, or Firm*—Michael J. McGowan; Prithvi C. Lall; Michael F. Oglo

[57] ABSTRACT

A stress relief backshell assembly made in two halves to allow the backshell to be fastened on either side of a cable. The backshell elements are assembled to an electrical connector, without cable/connector disassembly. The stress relief backshell prevents stress from affecting the connection between the cable elements and the connector and thus causing a gap in the connection. The backshell assembly includes two backshell halves with ring shaped front portions for engaging and gripping the cable end of the connector, ears extending rearward along the cable, and clamp members which clamp to the ears compressing the cable therebetween. This divided backshell assembly thus allows backshells to be easily removed and replaced. Backshell assemblies may be manufactured in both straight and angled configurations.

9 Claims, 3 Drawing Sheets

STRESS RELIEF BACKSHELL ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to stress relief backshells for cable connectors and more particularly to a backshell assembly in both angled and straight configurations which can be easily removed and replaced without disassembling the connector.

(2) Description of the Prior Art

Stress relief backshell assemblies are well known in the art. The purpose of these assemblies is to prevent separation of cable element wires from connector assemblies caused by cable tension or bending. The weakest point in a multi-element electrical cable is where the cable elements are connected to a termination device or to another cable. Any tension in the cable may cause uncoupling of cable elements from the connector, and a corresponding loss of data or power transfer. Likewise, bending of a cable near one of its attached connectors causes tension in the outer elements of the cable resulting in possible element separation from the connector and loss of electrical contact.

Backshell assemblies were devised to allow stress due to tension or bending to be transmitted away from the joint between the cable and connector by the connector and backshell instead of by the cable elements. Present backshells commonly have a ring-shaped front portion which engages the connector, two ear portions extending from the front portion rearward along the cable away from the connector, two clamp members, positioned at the end of the ear portions away from the connector, for compressing the cable therebetween at the distal end of the ear portions, and fasteners to tighten the clamp members against the cable. When the cable/connector assembly is placed in tension, friction between the backshell clamp and the cable transmits stress from the cable/clamp joint directly to the connector assembly. This stress transmission through the backshell acts to maintain slack in the cable at the connection between the elements and the connector thereby preventing detachment. When a cable is bent at or near the connection, the backshell absorbs the bending stress by providing a rigid structure from the clamp to the connector.

Present stress relief backshells are available in many configurations and sizes. Variations on the basic design include a widened front ring portion extending along the cable to provide protection from compression and friction and an angled front ring portion or angled ears to accommodate a bend in the cable near the connection. Backshells are available for many kinds of connectors, including multi-element, coaxial, and telephone cables.

The disadvantage of prior art circular backshells is that if the configuration of the cable changes and an angled backshell is needed, the connector must be disassembled and removed from the end of the cable. The prior art backshell must be inserted over the end of the cable and the connector then must be reassembled to the cable elements. Reassembly of the connector involves insertion and electrical connection of a plurality of wires or cable elements into apertures on the rear side of the connector. Disassembling and assembling a cable connector joint can take up to six hours. Eliminating the need to remove connectors when changing the configuration of a cable saves a great deal of time and labor particularly in a research and development environment.

SUMMARY OF THE INVENTION

Accordingly, it is a general purpose and object of the present invention to provide a stress relief means for relieving stress caused by tension and bending of a cable at or near the connection between a cable and a connector.

It is a further object that such stress relief means be installable and removable without disconnecting or disassembling the connection.

It is yet another object that such stress relief means be available in both angled and straight configurations.

These objects are accomplished with the present invention by providing a stress relief backshell which can be installed around the cable at the joint between the cable and connector rather than having to pass over the cable end. Such passage over the cable end requires disassembly when the cable has already been attached to a connector. To accomplish this installation the stress relief backshell is made in two halves, each half having a ring portion and an ear portion. The ring portion of each half is positioned on each side of the end of the connector nearest the cable and fastened together so as to grip the cable end of the connector. Clamps are then fastened to the distal ends of the ear portions on each backshell half thus compressing the cable between the clamps. The backshell can be removed from the cable connector by removing the clamps and fasteners and splitting the backshell halves. The terminal cable connector thus does not need to be detached or disassembled from the cable.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein.

DESCRIPTION OF THE PREFERRED EMBODIMENT

Figure 1:
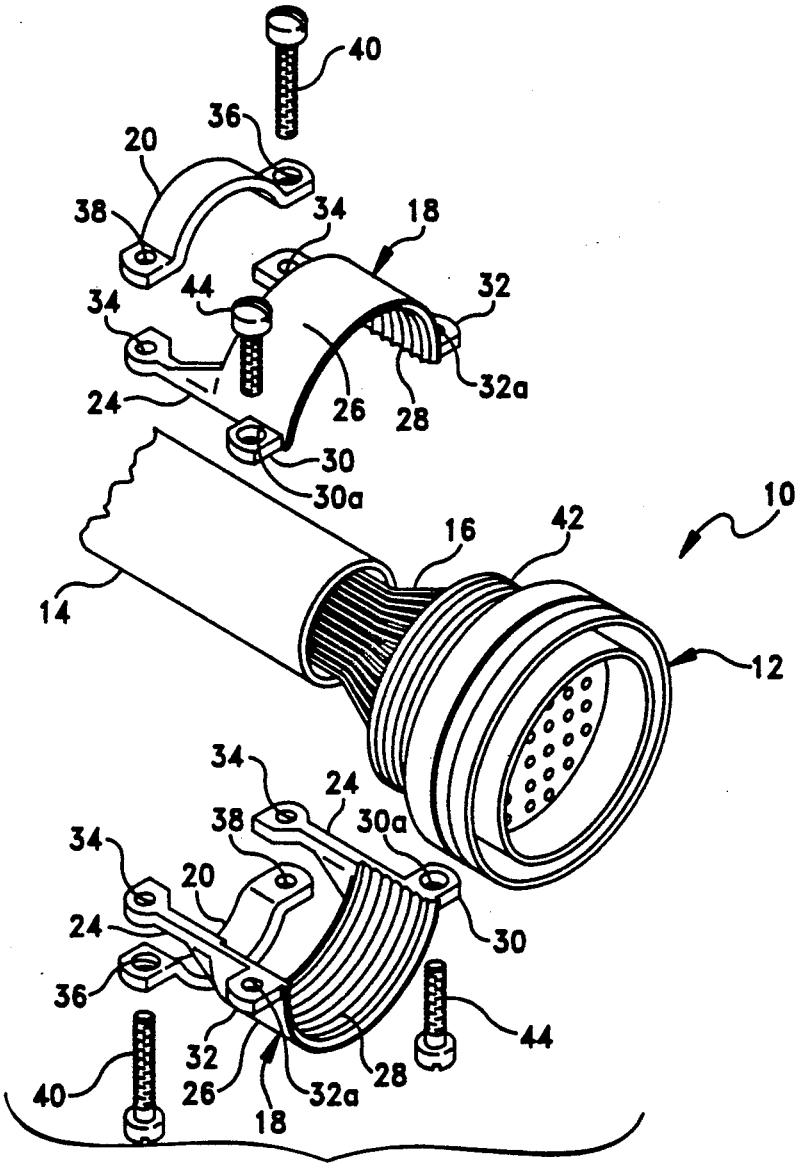
FIG. 1 shows an exploded perspective view of a two piece stress relief backshell according to the present invention.

Referring now to FIG. 1 there is shown an exploded view of a stress relief backshell assembly 10 according to the present invention. A connector 12 is joined to a cable 14 having a plurality of cable elements 16 which may be wires, optical fibers or the like. Connector 12 has an outside diameter much greater than the outside diameter of cable 14. Backshell stress relief assembly 10, comprising two identical backshell halves 18 and two identical arcuate clamp members 20, is affixed to the cable side of connector 12 with cable 14 passing therebetween. Each backshell half 18 comprises two ear portions 24 parallel to each other and extending along cable 14 away from connector 12, a semicircular front portion 26 having a threaded inner surface 28, and two eye-tabs, a clearance eye-tab 30 and a threaded eye-tab 32 extending radially from front portion 26. Eye-tab 30 has a clearance aperture 30*a* therein and therethrough. Eye-tab 32 has a threaded aperture 32*a* therein and therethrough. Clearance eyetab 30 is disposed at one end of the semicircle, and threaded eye-tab 32 is disposed at the other end of the semicircle. Each ear portion 24 has a clamp aperture 34 at its end away from front portion 26, the axis of clamp aperture 34 being oriented transversely to the longitudinal axis of combined front portions 26 and parallel to the axis of clamp aperture 34 at the extremity of other ear portion 24. Each clamp member 20 is a rectangular plate shaped to have an arched portion at its center of a diameter matching the cable to be secured and flat portions at the extremities with clamp member apertures 36 and 38 disposed therein and therethrough. Clamp member aperture 36 has a diameter sized to provide clearance for a bolt 40 while clamp member aperture 38 on each member 20 is preferably threaded to receive bolts 40 joining members 20 to respective ear portions 24 although clamp member aperture 38 may be an unthreaded clearance size and instead a nut (not shown) may be employed in cooperation with bolts 40.

The backshell assembly components can be made from any material with sufficient strength an desired machining characteristics. The preferred material is aluminum; however, steel or other metal material may be used as well as non-metallic materials.

Figure 4:
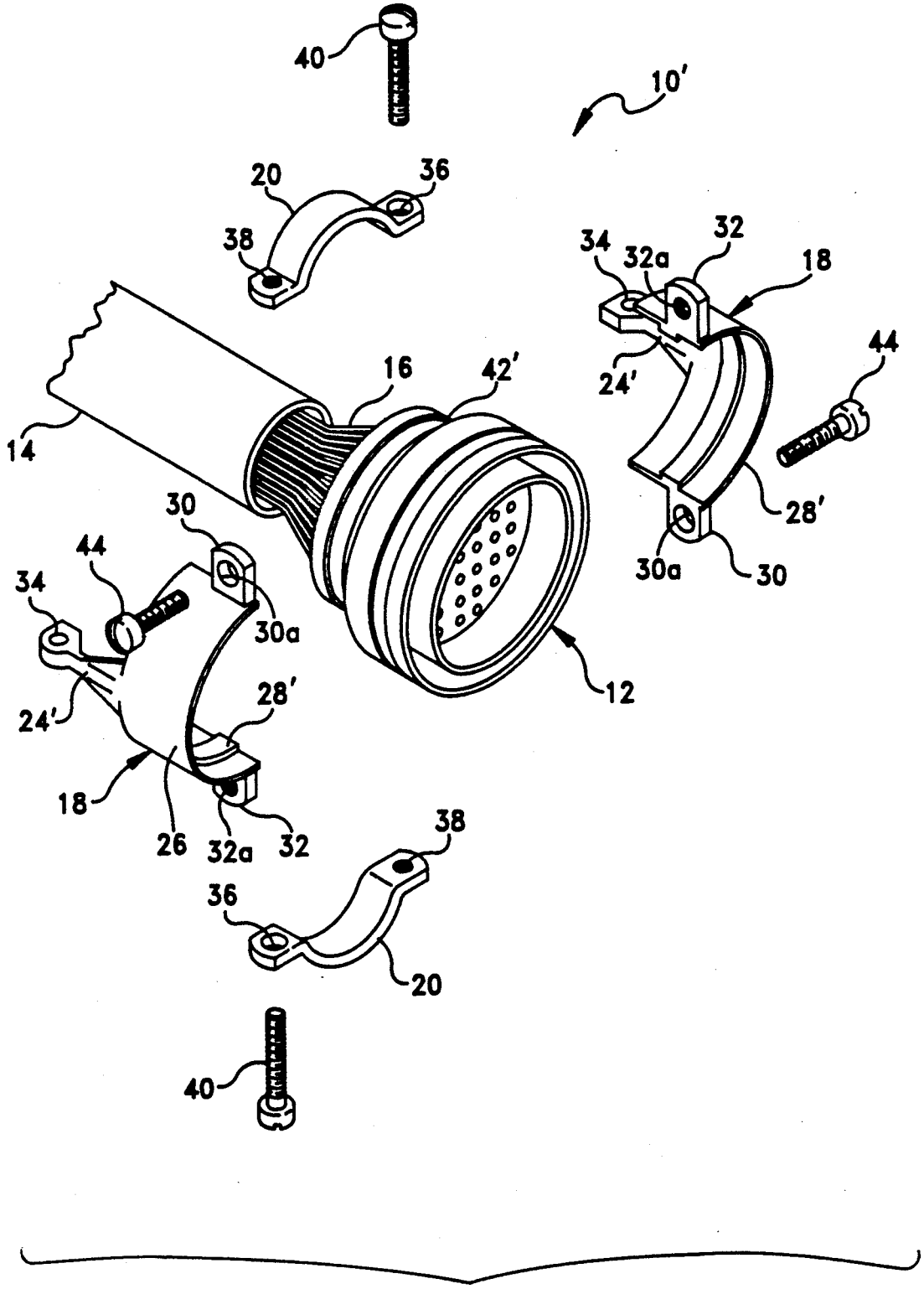
FIG. 4 shows an exploded perspective view of an alternate embodiment of a two piece stress relief backshell having the ring-shaped front portion split into two halves at a location on the periphery thereof remote from the location where the ears are formed.

Backshell halves 18 are fastened on either side of connector 12, the threaded inner surface 28 thereof engaging the external thread 42 on the cable end of connector 12. It is recognized that another structure such as an annular tongue and groove (as shown in FIG. 4) can also be used to provide the same function as threaded inner surface 28 and threaded connector 42. The backshell halves 18 are held together by bolts 44 extending through clearance diameter eye-tab aperture 30*a* on first backshell half 18 and engaging the threading inside corresponding threaded eye-tab aperture 32*a* On second backshell half 18. Clamp members 20 are affixed on either side of cable 14 at the distal end of ear portions 24 by bolts 40. A first bolt 40 joins first clamp member 20 through clamp member aperture 36 then through clamp aperture 34 in ear portion 24 on first backshell half 18, through clamp aperture 34 in ear portion 24 on second backshell half 18 and engaging second clamp member 20 at threaded clamp member aperture 38, the two ear portions 24 forming an ear. Likewise, the clamp member aperture 36 in second clamp member 20 is joined by second bolt 40 through clamp apertures 34 with ear portions 24 on each backshell half 18 and first clamp member 20 at threaded clamp member aperture 38. When clamp members 20 are affixed to ear portions 24 the arched portions of clamp members 20 are selected so as to form an opening with average diameter slightly less than that of cable 14 resulting in the compression of cable 14 between clamp members 20.

The compression created when clamp members 20 are tightened against cable 14 maintains the slack provided in cable 14 between clamp members 20 and connector 12. Ears 24 and clamp members 20 prevent transmission of bending stress or tension experienced by cable 14 to the joint between cable 14 and connector 12.

Figure 2:
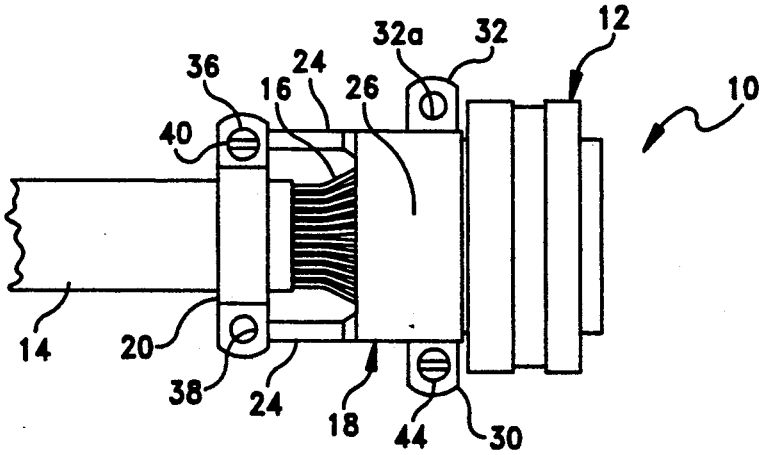
FIG. 2 shows a plan view of a connector with the two piece stress relief backshell of FIG. 1 assembled thereto.

FIG. 2 shows a plan view of connector 12 with the two piece stress relief backshell 10 of FIG. 1 assembled thereto.

Figure 3:
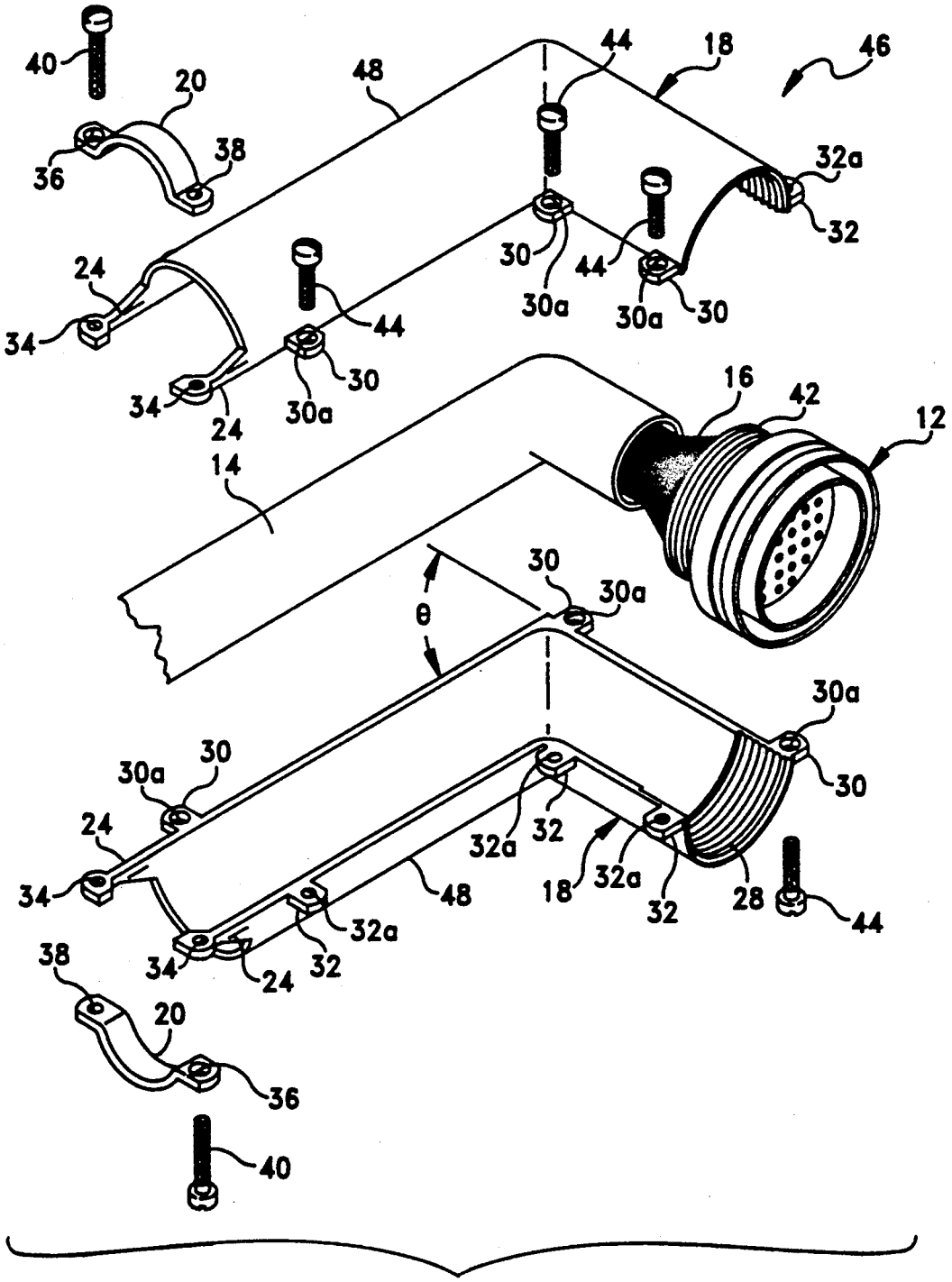
FIG. 3 shows an exploded perspective view of an alternate embodiment of the two piece stress relief backshell of FIG. 1 adapted for an angled connection.

FIG. 3 shows an exploded view of an angled backshell stress relief assembly 46 having an extension portion 48 extending from front portion 18. Extension portion 48 is affixed to front portion 18 at a preselected bend of angle $\theta$ chosen to accommodate the intended cable deployment angle. Angle $\theta 0$ generally varies between 0 and 90 degrees. As shown, extension portion 48 has additional sets of eye-tabs 30 and 32 with corresponding apertures 30*a* and 32*a* therein placed at preselected intervals to preserve contact between backshell halves 18 in the assembled state.

FIG. 4 shows an exploded view of an alternate embodiment 10' of the two piece backshell of FIG. 1 with the semicircular front portion 26 halves being separated at a preselected angular distance from ears 24', e.g., 90 degrees. In this embodiment, each backshell half 18 has only one ear 24' with a clamp aperture 34 through the distal end thereof. Backshell halves 18 are fastened on either side of connector 12, an annular tongue structure 28' on the inner surface thereof engaging an annular groove 42' on the cable end of connector 12. As an alternate feature, the internal surface of backshell halves 18 and the external surface of connector 12 can be threaded as in FIG. 1 to provide the same function. Backshell halves 18 are held together by bolts 44 extending through clearance eye-tab aperture 30*a* on first backshell half 18 and engaging threading inside corresponding threaded eye-tab aperture 32*a* on second backshell half 18. Clamp members 20 are affixed in much the same manner as in FIG. 1, being disposed on either side of cable 14 by bolts 40 extending through first clamp member aperture 36, through clamp aperture 34 and engaging second clamp member aperture 38. This embodiment is easier to manufacture because of the one piece ears 24' which are split in the embodiment shown in FIG. 1.

The main advantage of the present invention over the prior art is that stress relief is provided by a backshell assembly that can be easily removed and replaced. The backshell can be separated and removed without removing or disconnecting the connector when the user needs to replace a straight backshell with an angled backshell or to replace a corroded or damaged backshell.

What has thus been described is stress relief backshell assembly made in two halves in order that it may be affixed to a cable connector without disassembling the attached cable from the connector.

Obviously many modifications and variations of the present invention may become apparent in light of the above teachings. For example: as previously recited, the semicircular front portion of the backshell may be divided between the ear portions as in FIG. 4 rather than at the ear portions as in FIGS. 1–3; the front portion may also be lengthened as desired to protect the cable against compression and friction; backshell assemblies may be made in a wide variety of sizes and styles to accommodate different diameters and types of cables; backshell assemblies may be angled at or along the ear portion or the front portion; the backshell assembly may be made with an angle greater than ninety degrees; no threading is required in the eye-tabs, instead nuts may be used to fasten bolts through the eye-tabs; any front portion of a backshell may engage a connector with an annular tongue and groove structure as in FIG. 4 vice threads as in FIGS. 1 and 3; and a backshell assembly may be made of any other material with sufficient strength, machinability and rigidity, such as another metal, an elastomer or a composite.

In light of the above, it is therefore understood that within the scope of the appended claims, the invention may be practiced otherwise than as specifically described.

What is claimed is:

1. A device for relieving stress in a cable joined to a connector comprising:

two backshell halves, disposed about said cable, each half having a semicircular front portion with flat bases at the ends of the front portion and at least one ear portion extending rearwardly away from said connector in a direction generally parallel to said cable;

clamping means, disposed about the rearmost portion of said ears, for clamping said backshell halves to said cable in such a way that said clamped backshell halves form a cylindrical assembly having a longitudinal axis parallel to said cable;

engagement means, formed integrally with the inside surface of said front portion of said backshell halves, for fixedly attaching said backshell halves to said connector in such a way as to restrain motion in a direction parallel to said cable; and fastener means, affixed to said front portion of each of said backshell halves, for fixedly fastening the flat bases of the front portion of said backshell halves together about said connector in such a way as to act in cooperation with said engagement means to restrain parallel and transverse motion of said backshell assembly relative to said connector.

2. The device of claim 1, wherein said clamping means further comprises two clamp members; and at least two clamp fasteners, said clamp fasteners affixing said clamp members to the rearmost end of said ear portions, with one of said clamp members affixed on either side of said cable, said affixed clamp members acting so as to compress said cable therebetween.

3. The device of claim 2, wherein said longitudinal axis of said cylindrical assembly is bent at a preselected angle.

4. The device of claim 3, wherein each backshell half has at least two ear portions, each ear portion extending rearward, parallel to the other ear portion, from each flat base of the semicircular front portion of the backshell half.

5. The device of claim 4, wherein said engagement means for attaching the backshell to the connector is an annular tongue and groove fit between the interior of the semicircular portion of the backshell halves and the outside of the connector.

6. The device of claim 4, wherein said engagement means for attaching the backshell to the connector is threads formed on the inside of the semicircular portion of said backshell halves and on the outside of the connector.

7. The device of claim 3, wherein each backshell has one ear portion extending rearward, parallel to the cable, from the middle of the front portion of each backshell half.

8. The device of claim 7, wherein said engagement means for attaching the backshell to the connector is an annular tongue and groove fit between the interior of the semicircular portion of the backshell halves and the outside of the connector.

9. The device of claim 7, wherein said engagement means for attaching the backshell to the connector is threads formed on the inside of the semicircular portion of said backshell halves and on the outside of the connector.

* * * * *